US011187412B2

(12) United States Patent
Bilse et al.

(10) Patent No.: US 11,187,412 B2
(45) Date of Patent: Nov. 30, 2021

(54) FLOW CONTROL WALL ASSEMBLY FOR HEAT ENGINE

(71) Applicant: General Electric Company, Schenectady, NY (US)

(72) Inventors: Andrew Scott Bilse, Cincinnati, OH (US); Craig Alan Gonyou, Blanchester, OH (US); Ryan Christopher Jones, Cincinnati, OH (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 181 days.

(21) Appl. No.: 16/108,674

(22) Filed: Aug. 22, 2018

(65) Prior Publication Data

US 2020/0063963 A1 Feb. 27, 2020

(51) Int. Cl.

*F23R 3/00* (2006.01)
*F23R 3/04* (2006.01)
*F23R 3/28* (2006.01)

(52) U.S. Cl.

CPC ..... *F23R 3/04* (2013.01); *F23R 3/002* (2013.01); *F23R 3/005* (2013.01); *F23R 3/283* (2013.01); *F23R 2900/00001* (2013.01); *F23R 2900/03044* (2013.01)

(58) Field of Classification Search

CPC ..... F23R 3/002; F23R 3/28–286; F23R 2900/03044; F23R 2900/03041–03043; F23R 3/04; F23R 3/005; F23R 2900/00001; F23R 2900/03042; F23R 3/10; F02C 6/00

See application file for complete search history.

(56) References Cited

U.S. PATENT DOCUMENTS

| | | | | |
|---|---|---|---|---|
| 2,974,485 | A | 3/1961 | Schiefer | |
| 4,030,875 | A | 6/1977 | Grondahl et al. | |
| 4,109,459 | A | 8/1978 | Ekstedt et al. | |
| 4,719,748 | A * | 1/1988 | Davis, Jr. | F01D 5/187 60/39.37 |
| 5,077,969 | A | 1/1992 | Liang et al. | |
| 6,101,814 | A | 8/2000 | Hoke et al. | |
| 6,351,947 | B1 | 3/2002 | Keller et al. | |
| 6,826,913 | B2 | 12/2004 | Wright | |
| 6,868,675 | B1 | 3/2005 | Kuhn et al. | |
| 7,631,502 | B2 | 12/2009 | Burd et al. | |
| 7,874,159 | B2 | 1/2011 | Gerendas et al. | |
| 9,377,198 | B2 | 6/2016 | Eastwood et al. | |
| 9,377,200 | B2 | 6/2016 | Sandelis | |
| 9,939,154 | B2 | 4/2018 | Cunha | |
| 2002/0116929 | A1 * | 8/2002 | Snyder | F23R 3/002 60/740 |
| 2004/0211188 | A1 * | 10/2004 | Alkabie | F23R 3/002 60/772 |
| 2013/0232978 | A1 * | 9/2013 | Dai | F23R 3/28 60/737 |
| 2017/0227222 | A1 | 8/2017 | Baumgartner et al. | |
| 2017/0248311 | A1 | 8/2017 | Ozem et al. | |
| 2019/0093892 | A1 * | 3/2019 | Rimmer | F23R 3/50 |

* cited by examiner

*Primary Examiner* — Gerald L Sung
*Assistant Examiner* — Rene D Ford
(74) *Attorney, Agent, or Firm* — Venable LLP; Edward A. Kmett; Michele V. Frank

(57) ABSTRACT

A heat engine including a wall assembly is generally provided. The wall assembly includes a plurality of radial walls coupled together via a connecting member. The radial wall defines a flow opening therethrough. A flow cavity is defined between the plurality of radial walls and the connecting member.

20 Claims, 4 Drawing Sheets

FLOW CONTROL WALL ASSEMBLY FOR HEAT ENGINE

FIELD

The present subject matter relates generally to wall assemblies for heat engines. The present subject matter relates more specifically to wall assemblies between cold flow paths and hot flow paths of heat engines.

BACKGROUND

Heat engines, such as turbo machines, generally need to control leakages and variations in flow across walls between a cold flowpath and a hot flowpath. Certain seals, such as spline seals, may be incorporated to reduce or control leakage. However, despite known structures for leakage or flow control, relatively large amounts of leakage or flow variation are permitted at the expense of engine performance. More specifically, such relatively large leakages or flow variations may adversely affect engine operability or performance, such as at the combustion section. As such, there is a need for a wall assembly that may reduce leakage, control overall pressure drop, control or modulate cooling, or improve durability of the engine.

BRIEF DESCRIPTION

Aspects and advantages of the invention will be set forth in part in the following description, or may be obvious from the description, or may be learned through practice of the invention.

An aspect of the present disclosure is directed to a heat engine defining a hot flow path and a cold flow path. The heat engine includes a wall assembly including a plurality of radial walls coupled together via a connecting member. The radial wall defines a flow opening therethrough. A flow cavity is defined between the plurality of radial walls and the connecting member.

In one embodiment, the wall assembly further includes a mount wall extended substantially co-directional to the connecting member. The mount wall is coupled to an outer wall of the heat engine.

In another embodiment, the radial wall defines a thickness and the flow cavity defines a cross sectional area. A ratio of the thickness to the cross sectional area is between 0.1:1 and 10:1.

In still another embodiment, the plurality of radial walls includes two or more radial walls including a hot side radial wall adjacent to a hot flow path and one or more cold side radial walls adjacent to a cold flow path defining a fluid temperature less than the hot flow path. In one embodiment, a gap is defined between the hot side radial wall and one or more of an inner wall or an outer wall surrounding the hot side radial wall.

In still yet another embodiment, the connecting member of the wall assembly is defined between 70 degrees and between 110 degrees relative to the radial wall.

In another embodiment, the connecting member defines the flow opening.

Another aspect of the present disclosure is directed to a combustor assembly for a gas turbine engine. The combustor assembly includes a liner defining a combustion chamber and a deflector assembly including a plurality of radial walls coupled together via a connecting member. The radial wall defines a flow opening therethrough. A flow cavity is defined between the plurality of radial walls and the connecting member. A mount wall is coupled to the liner and the radial wall.

In one embodiment, the plurality of radial walls includes two or more radial walls including a hot side radial wall adjacent to the combustion chamber. The radial walls include one or more cold side radial walls disposed forward of the hot side radial wall.

In another embodiment, the radial wall defines a thickness and the flow cavity defines a cross sectional area. A ratio of the thickness to the cross sectional area is between 0.1:1 and 10:1.

In various embodiments, the combustor assembly further includes a deflector eyelet coupled to the radial wall; and a bulkhead assembly coupled to the liner wall forward of the deflector assembly. A cold flow path is defined between the bulkhead assembly, the deflector assembly, and the deflector eyelet.

In still various embodiments, the combustor assembly defines a first gap between the radial wall and the liner. In one embodiment, the first gap is defined substantially circumferentially.

In another embodiment, the flow opening defines a volume providing a pressure loss from the cold flow path to the combustion chamber between 0% and 50%.

In various embodiments, a hot side radial wall defines a first flow opening defining a first volume in fluid communication between the flow cavity and the combustion chamber. A cold side radial wall defines a second flow opening defining a second volume different from the first volume. The second flow opening defines the second volume in fluid communication between the cold flow path and the flow cavity.

In one embodiment, the first volume of the first flow opening corresponds to a pressure loss from the flow cavity to the combustion chamber between 0.1% and 25%. In another embodiment, the second volume of the second flow opening corresponds to a pressure loss from the cold flow path to the flow cavity between 0.1% and 25%. In yet another embodiment, the combustor assembly defines a second gap between the hot side radial wall and the deflector eyelet.

In one embodiment, the radial wall of the deflector assembly is defined substantially along a radial direction from a combustor centerline.

In another embodiment, the connecting member of the deflector assembly is defined between 70 degrees and 110 degrees relative to the radial wall.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

Figure 1:
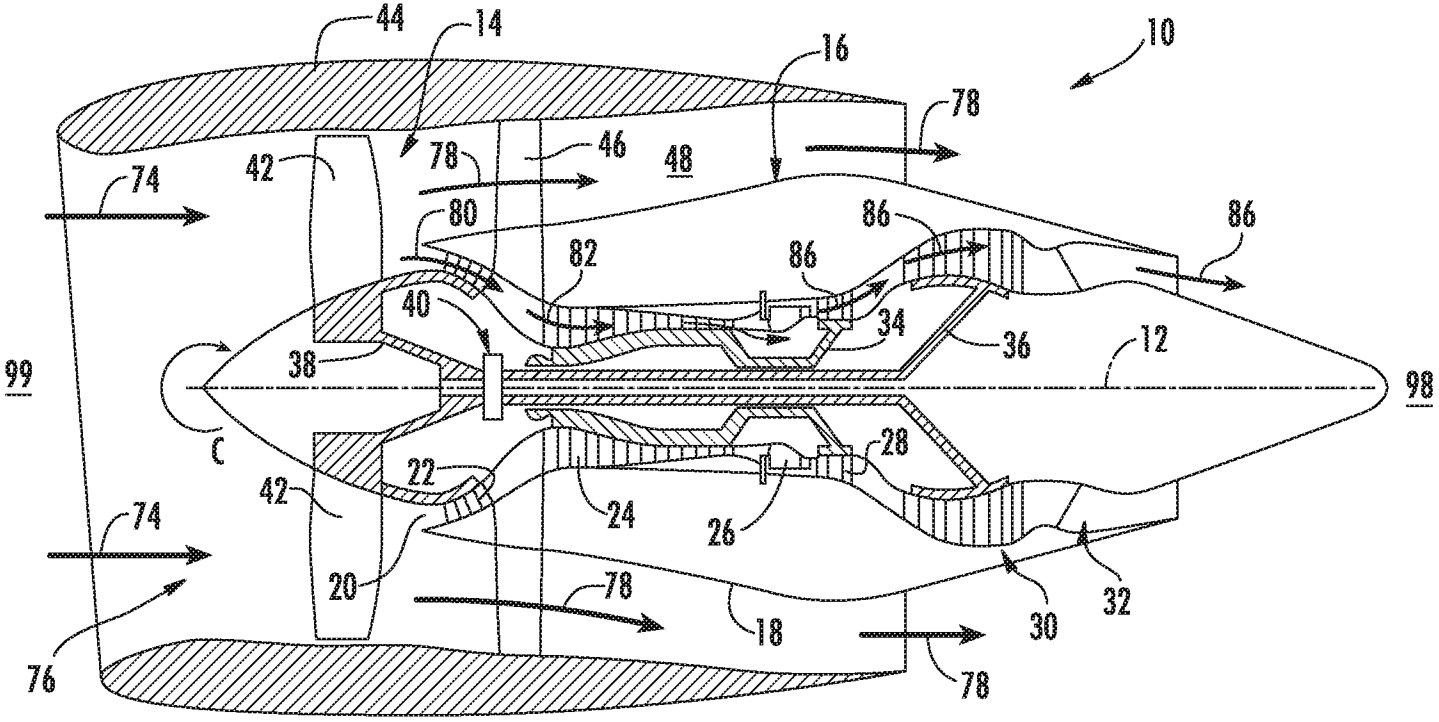
FIG. 1 is a schematic cross sectional side view of an exemplary heat engine according to an aspect of the present disclosure.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first", "second", and "third" may be used interchangeably to distinguish one component from another and are not intended to signify location or importance of the individual components.

The terms "upstream" and "downstream" refer to the relative direction with respect to fluid flow in a fluid pathway. For example, "upstream" refers to the direction from which the fluid flows, and "downstream" refers to the direction to which the fluid flows.

Approximations recited herein may include margins based on one more measurement devices as used in the art, such as, but not limited to, a percentage of a full scale measurement range of a measurement device or sensor. Alternatively, approximations recited herein may include margins of 10% of an upper limit value greater than the upper limit value or 10% of a lower limit value less than the lower limit value.

Embodiments of a wall assembly are generally provided herein that may reduce leakage and control overall pressure drop, control or modulate cooling, or improve durability of a heat engine, or portions thereof. Various embodiments of the wall assembly include a serial arrangement of two or more radial walls coupled together via one or more connecting members. A plurality of flow openings are defined through the radial wall, thereby enabling and controlling a pressure drop or leakage across the walls. The wall assembly may control an overall pressure loss or drop between a cold side flow path and a hot side flow path. The improved cooling structure and reduced leakage of across the wall assembly may further improve durability of the surrounding structure, such as a combustor assembly at a combustion section, or between colder secondary flow paths and warmer primary or core flow paths at the engine (e.g., at the compressor section, the turbine section, or the exhaust section, or heat exchangers, etc.). Embodiments of the wall assembly shown and described herein may improve overall performance or operability of the engine, or modules or components thereof.

Referring now to the drawings, FIG. 1 is a schematic partially cross-sectioned side view of an exemplary high bypass turbofan engine 10 herein referred to as "engine 10" as may incorporate various embodiments of the present disclosure. Although further described below with reference to a turbofan engine, the present disclosure is also applicable to turbomachinery in general, including turbojet, turboprop, and turboshaft gas turbine engines, including marine and industrial turbine engines and auxiliary power units. As shown in FIG. 1, the engine 10 has a longitudinal or axial engine centerline axis 12 that extends there through for reference purposes. The engine 10 defines a longitudinal direction L and an upstream end 99 and a downstream end 98 along the longitudinal direction L. The upstream end 99 generally corresponds to an end of the engine 10 along the longitudinal direction L from which air enters the engine 10 and the downstream end 98 generally corresponds to an end at which air exits the engine 10, generally opposite of the upstream end 99 along the longitudinal direction L. In general, the engine 10 may include a fan assembly 14 and a core engine 16 disposed downstream from the fan assembly 14.

The core engine 16 may generally include a substantially tubular outer casing 18 that defines an annular inlet 20. The outer casing 18 encases or at least partially forms, in serial flow relationship, a compressor section having a booster or low pressure (LP) compressor 22, a high pressure (HP) compressor 24, a combustion section 26, a turbine section including a high pressure (HP) turbine 28, a low pressure (LP) turbine 30 and a jet exhaust nozzle section 32. A high pressure (HP) rotor shaft 34 drivingly connects the HP turbine 28 to the HP compressor 24. A low pressure (LP) rotor shaft 36 drivingly connects the LP turbine 30 to the LP compressor 22. The LP rotor shaft 36 may also be connected to a fan shaft 38 of the fan assembly 14. In particular embodiments, as shown in FIG. 1, the LP rotor shaft 36 may be connected to the fan shaft 38 by way of a reduction gear 40 such as in an indirect-drive or geared-drive configuration. In other embodiments, the engine 10 may further include an intermediate pressure compressor and turbine rotatable with an intermediate pressure shaft altogether defining a three-spool gas turbine engine.

As shown in FIG. 1, the fan assembly 14 includes a plurality of fan blades 42 that are coupled to and that extend radially outwardly from the fan shaft 38. An annular fan casing or nacelle 44 circumferentially surrounds the fan assembly 14 and/or at least a portion of the core engine 16. In one embodiment, the nacelle 44 may be supported relative to the core engine 16 by a plurality of circumferentially-spaced outlet guide vanes or struts 46. Moreover, at least a portion of the nacelle 44 may extend over an outer portion of the core engine 16 so as to define a bypass airflow passage 48 therebetween.

Figure 2:
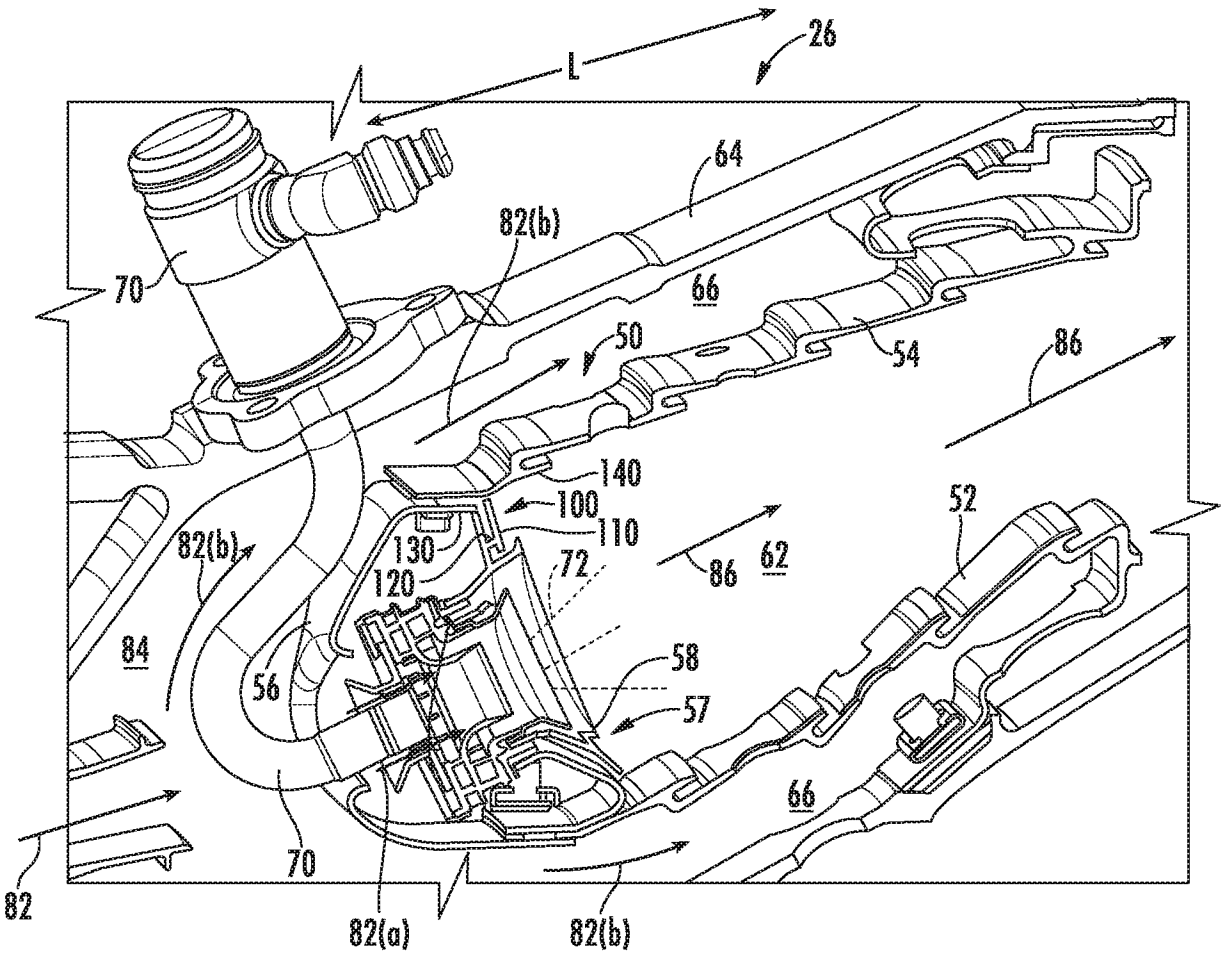
FIG. 2 is a schematic cross sectional side view of an exemplary combustion section of the engine depicted in FIG. 1.

FIG. 2 is a cross sectional side view of an exemplary combustion section 26 of the core engine 16 as shown in FIG. 1. As shown in FIG. 2, the combustion section 26 may generally include an annular type combustor 50 having an annular inner liner 52, an annular outer liner 54 and a bulkhead 56 that extends radially between upstream ends of the inner liner 52 and the outer liner 54 respectively. In other embodiments of the combustion section 26, the combustion assembly 50 may be a can-annular type. The combustor 50 further includes a deflector assembly 57 extended radially between the inner liner 52 and the outer liner 54 downstream of the bulkhead 56. As shown in FIG. 2, the inner liner 52 is radially spaced from the outer liner 54 with respect to engine centerline 12 (FIG. 1) and defines a generally annular combustion chamber 62 therebetween. In particular embodiments, the inner liner 52, the outer liner 54, and/or the deflector assembly 57 may be at least partially or entirely formed from metal alloys or ceramic matrix composite (CMC) materials.

It should be appreciated that although the exemplary embodiment of the combustor assembly 50 of FIG. 2 depicts an annular combustor, various embodiments of the engine 10 and combustion section 26 may define a can-annular or can combustor configuration.

As shown in FIG. 2, the inner liner 52 and the outer liner 54 may be encased within an outer casing 64. An outer flow passage 66 of a diffuser cavity or pressure plenum 84 may be defined around the inner liner 52 and/or the outer liner 54. The inner liner 52 and the outer liner 54 may extend from the bulkhead 56 towards a turbine nozzle or inlet to the HP turbine 28 (FIG. 1), thus at least partially defining a hot gas path between the combustor assembly 50 and the HP turbine 28. A fuel nozzle 70 may extend at least partially through the bulkhead 56 to provide a fuel 72 to mix with the air 82(*a*) and burn at the combustion chamber 62. In various embodiments, the bulkhead 56 includes a fuel-air mixing structure attached thereto (e.g., a swirler assembly).

During operation of the engine 10, as shown in FIGS. 1 and 2 collectively, a volume of air as indicated schematically by arrows 74 enters the engine 10 through an associated inlet 76 of the nacelle 44 and/or fan assembly 14. As the air 74 passes across the fan blades 42 a portion of the air as indicated schematically by arrows 78 is directed or routed into the bypass airflow passage 48 while another portion of the air as indicated schematically by arrow 80 is directed or routed into the LP compressor 22. Air 80 is progressively compressed as it flows through the LP and HP compressors 22, 24 towards the combustion section 26. As shown in FIG. 2, the now compressed air as indicated schematically by arrows 82 flows into a diffuser cavity or pressure plenum 84 of the combustion section 26. The pressure plenum 84 generally surrounds the inner liner 52 and the outer liner 54, and generally upstream of the combustion chamber 62.

The compressed air 82 pressurizes the pressure plenum 84. A first portion of the of the compressed air 82, as indicated schematically by arrows 82(*a*) flows from the pressure plenum 84 into the combustion chamber 62 where it is mixed with the fuel 72 and burned, thus generating combustion gases, as indicated schematically by arrows 86, within the combustor 50. Typically, the LP and HP compressors 22, 24 provide more compressed air to the pressure plenum 84 than is needed for combustion. Therefore, a second portion of the compressed air 82 as indicated schematically by arrows 82(*b*) may be used for various purposes other than combustion. For example, as shown in FIG. 2, compressed air 82(*b*) may be routed into the outer flow passage 66 to provide cooling to the inner and outer liners 52, 54.

Referring now to FIGS. 3-6, embodiments of a wall assembly 100 are generally provided. The wall assembly 100 is disposed between a hot flow path 101 and a cold flow path 102. For example, the wall assembly 100 generally divides or separates the hot flow path 101 from the cold flow path 102. The hot flow path 101 defines a passage, chamber, or circuit at which a hot fluid flows, in which the hot fluid defines a higher temperature than a cold fluid at which is flowed in a passage, chamber, or circuit defined by the cold flow path 102. For example, the hot flow path 101 may include the combustion chamber 62 (FIG. 2) or the core flow path 70 at the turbine section 31 or the exhaust section 32 (FIG. 1). As another example, the cold flow path 102 may include the diffuser cavity 84 or outer flow passage 66 (FIG. 2) surrounding the liners 52, 54 defining the combustion chamber 62. As yet another example, the cold flow path 102 may include one or more secondary flow paths (not shown) surrounding the core flow path 70 surrounding the compressor section 21, the combustion section 26, the turbine section 31, or the exhaust section 32. In still other embodiments, the hot flow path 101 and the cold flow path 102 may be defined relative to a heat exchanger.

Referring still to FIGS. 3-6, the wall assembly 100 includes a plurality of radial walls 110 coupled together via a connecting member 120. In one embodiment, the wall assembly 100 includes two or more radial walls 110 coupled together via the connecting member 120. The radial wall 110 defines a flow opening 105 through the radial wall 110. In various embodiments, the flow opening 105 is further defined through the connecting member 120. A flow cavity 115 is defined between the plurality of radial walls 110 and the connecting member 120. For example, the flow cavity 115 is defined between a pair of the radial walls 110 and the connecting member 120. As another example, the flow cavity 115 is defined between the two or more radial walls 110 and the connecting member 120. In various embodiments, the plurality of (e.g., two or more) radial walls 110 includes a hot side radial wall 111 adjacent to the hot flow path 101 and one or more cold side radial walls 112 disposed between the hot side radial wall 111 and the cold flow path 102. In one embodiment, the cold side radial wall 112 is disposed adjacent to the cold flow path 102. In still various embodiments, the hot side radial wall 111 is more proximate to the hot flow path 101 than the cold side radial wall 112. In other embodiments, each of the cold side radial walls 112 is more proximate to the cold flow path 102 than the hot side radial wall 111.

In various embodiments, the radial walls 110 may extend along a first direction 91 and the connecting member 120 may extend along a second direction 92 different from the first direction 91. For example, the first direction 91 may be along the radial direction R (FIGS. 1-2) and the second direction 92 may be along the longitudinal direction L (FIGS. 1-2). However, it should be appreciated that the first direction 91 may be along the longitudinal direction L and the second direction 92 may be along the radial direction R. In various embodiments, the connecting member 120 is defined or extended between 70 degrees and 110 degrees relative to the radial wall 110. In other embodiments, the connecting member 120 is defined approximately perpendicular or 90 degrees relative to the radial wall 110.

Various embodiments of the wall assembly 100 may include a plurality of radial walls 110 in adjacent arrangement along the first direction 91 coupled together via a plurality of connecting members 120 extended along the second direction 92 between pairs of the radial walls 110. For example, the wall assembly 100 includes two or more radial walls 110 coupled together by one or more connecting members 120. As another example, FIG. 3 generally depicts a pair of radial walls 110 coupled together via the connecting member 120. As yet another example, FIGS. 4-6 generally depict a plurality of radial walls 110 coupled together via a plurality of the connecting member 120.

In still various embodiments, the radial wall 110 defines a thickness 113. The flow cavity 115 defines a cross sectional area 114. For example, the cross sectional area 114 is co-planar to the thickness 113 of the radial wall 110. In one embodiment, a ratio of the thickness 113 of the radial wall 110 to the cross sectional area 114 of the flow cavity 115 is between 0.1:1 and 10:1. For example, in one embodiment, the thickness 113 of the radial wall 110 may be approximately equal to the cross sectional area 114 of the flow cavity 115. In another embodiment, the thickness 113 of the radial wall 110 may be approximately ten times (10×) the cross sectional area 114 of the flow cavity 115. In yet another embodiment, the thickness 113 of the radial wall 110 may be approximately five times (5×) the cross sectional area 114 of the flow cavity 115. In still yet another embodiment, the thickness 113 of the radial wall 110 may be approximately one-tenth (0.1×) the cross sectional area of the flow cavity 115. In various embodiments, the thickness 113 is between one-tenth (0.1×) the cross sectional area 114 and ten times (10×) the cross sectional area 114 of the flow cavity 115. In still various embodiments, the thickness 113 is between one-tenth (0.1×) the cross sectional area 114 and five times (5×) the cross sectional area 114 of the flow cavity 115.

Referring still to FIGS. 3-6, the wall assembly 100 may further include an outer wall 140 surrounding the radial walls 110 and the connecting member 120. For example, the outer wall 140 may be disposed substantially along the second direction 92 and surrounding the radial walls 110 along the first direction 91. In various embodiments, the wall assembly 100 may further include an inner wall 150 surrounding the radial walls 110 and the connecting member 120. For example, the inner wall 150 may be disposed substantially along the second direction 92 and disposed inward of the radial walls 110 and the outer wall 140 along the first direction 91. In various embodiments, the inner wall 150 is coupled to one or more of the radial walls 110. In one embodiment, such as depicted in regard to FIG. 3 and FIGS. 5-6, the inner wall 150 is coupled to one or more of the cold side radial wall 110.

In one embodiment, a mount wall 130 is extended substantially co-directional to the connecting member 120. The mount wall 130 may be coupled to the outer wall 140. In various embodiments, the mount wall 130 is further coupled to one or more of the radial walls 110. For example, the mount wall 130 may be coupled to the cold side radial wall 112 of the plurality of (e.g., two or more) radial walls 110. As another example, the mount wall 130 may further be coupled to the cold side radial wall 112 and the connecting member 120.

In still various embodiments, the wall assembly 100 including the plurality of radial walls 110 includes at least two radial walls 110 and one hundred or fewer radial walls 110. In another embodiment, the wall assembly 100 includes at least two radial walls 110 and fifty or fewer radial walls 110. In still another embodiment, the wall assembly 100 includes at least two radial walls 110 and twenty or fewer radial walls 110. It should be appreciated that the wall assembly 100 may generally include at least two radial walls 110, and a maximum number of the radial walls 110 may be based at least on a desired pressure drop between each pair of radial walls 110, an overall pressure drop or both, such as further described below. Additionally, or alternatively, a maximum number of radial walls 110 may be based at least on one or more ratios of thickness 113 to cross sectional area 114, such as described above.

Figure 3:
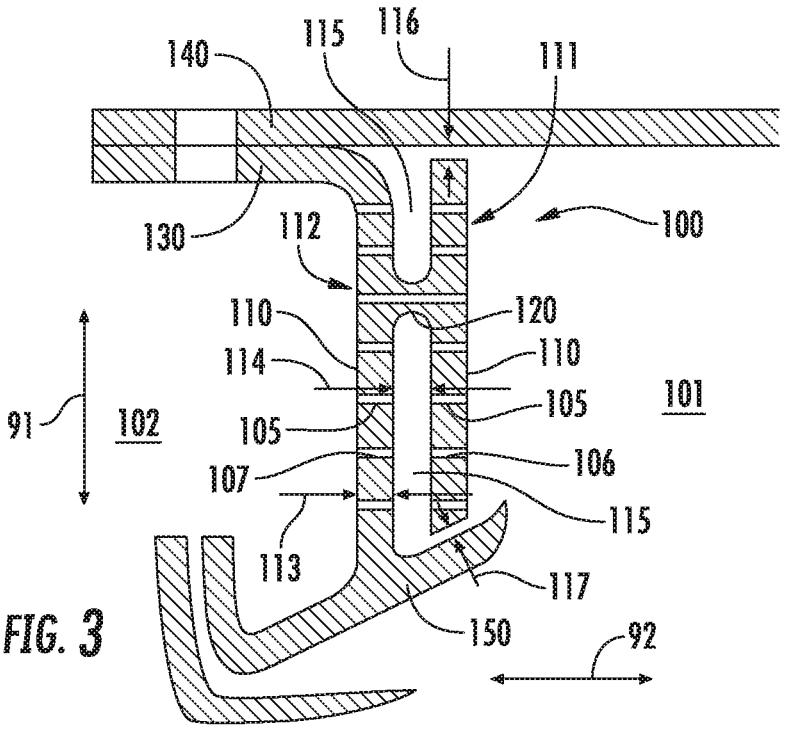
FIGS. 3-6 are exemplary embodiments of a wall assembly of the engine of FIGS. 1-2.
Figure 4:
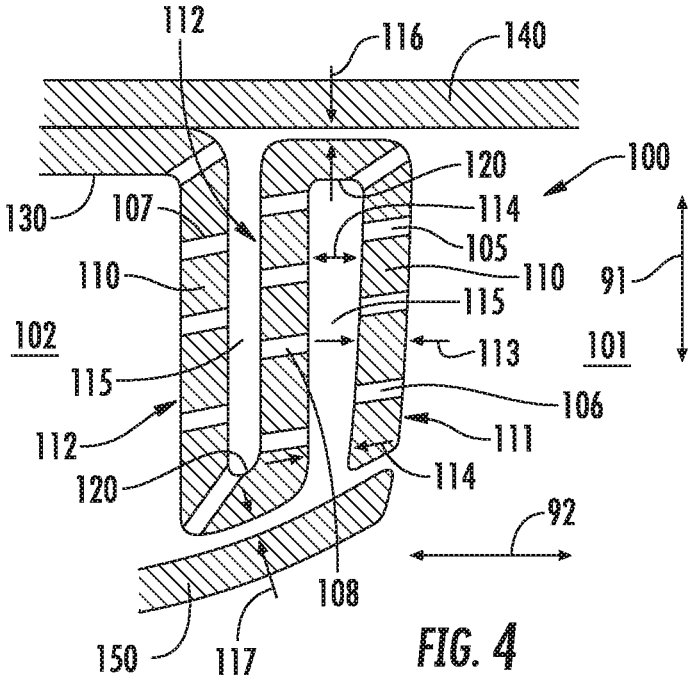
Figure 5:
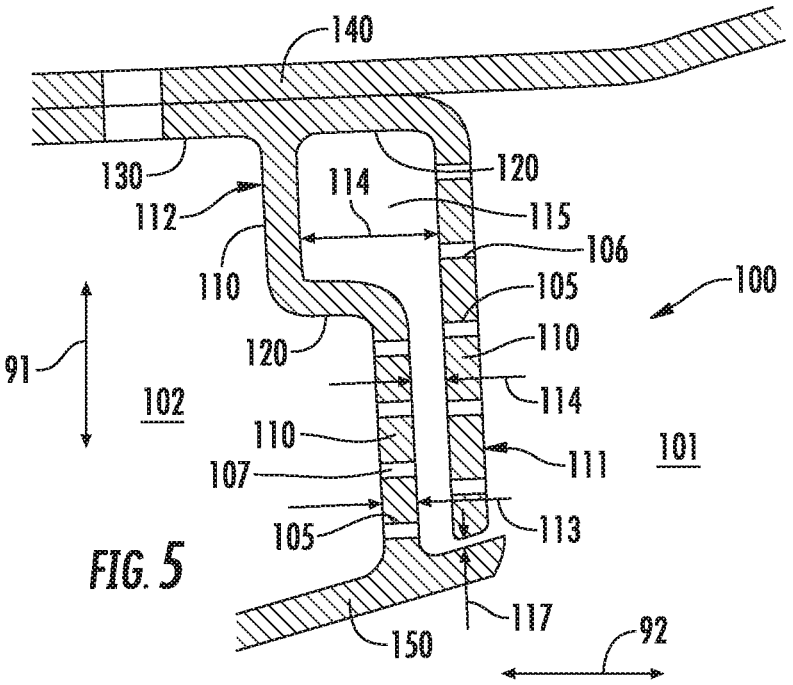
Figure 6:
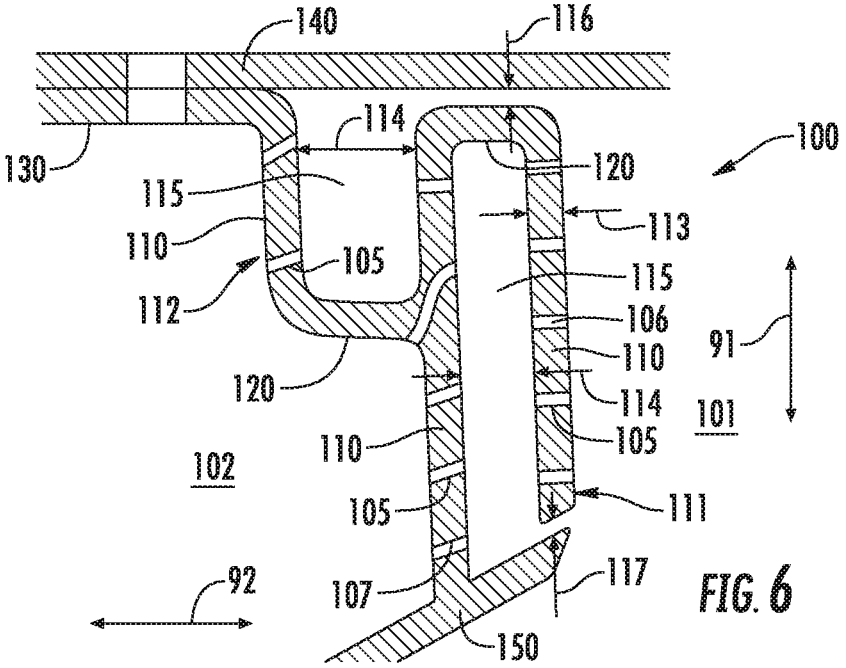

In various embodiments, such as depicted in regard to FIGS. 3-4 and FIG. 6, a first gap 116 is defined between the hot side radial wall 111 and the outer wall 140. In another embodiment, such as depicted in regard to FIGS. 3-6, a second gap 117 is defined between the inner wall 150 and one or more of the radial walls 110 or connecting member 120.

Referring still to FIGS. 3-6, in various embodiments, the plurality of flow openings 105 each define a volume providing a pressure loss from the cold flow path 102 to the hot flow path 101. For example, the pressure loss across the combustion chamber 62 may range between 0% and 50%.

The wall assembly 100 defines an overall pressure loss or pressure drop, defined by:

$$\text{overall pressure loss} = \frac{P1 - P2}{P1}$$

The overall pressure loss or pressure drop is defined at least by a difference of a first pressure P1 at the cold flow path 102 proximate to the cold side radial wall 112 and a second pressure P2 at the hot flow path 101 proximate to the hot side radial wall 111, together divided by the first pressure P1. In one embodiment, the wall assembly defines the pressure loss between 0.1% and 50%.

In another embodiment, the wall assembly 100 defines a hot side radial wall pressure loss from the flow cavity 115 to the hot side flow path 101 defined by:

$$\text{hot side first wall pressure loss} = \frac{P3 - P2}{P3}$$

The hot side radial wall pressure loss or pressure drop is defined at least by a difference of a third pressure P3 at the flow cavity 115 adjacent to the hot side radial wall 111 and the second pressure P2 at the hot flow path 101, together divided by the third pressure P3. In one embodiment, the wall assembly defines the hot side radial wall pressure loss between 0.1% and 25%.

In yet another embodiment, the wall assembly 100 defines a cold side radial wall pressure loss from the cold flow path 102 to the flow cavity 115 defined by:

$$\text{cold side first wall pressure loss} = \frac{P1 - P3}{P1}$$

The cold side radial wall pressure loss or pressure drop is defined at least by a difference of the first pressure P1 at the cold flow path 102 adjacent to the cold side radial wall 112 and the third pressure P3 at the flow cavity 115, together divided by the first pressure P1. In one embodiment, the wall assembly defines the cold side radial wall pressure loss between 0.1% and 25%.

In still various embodiments, the wall assembly 100 may define a flow cavity pressure loss between adjacent flow cavities 115 between 0.1% and 25%.

Referring still to FIGS. 3-6, in still yet various embodiments, the plurality of flow openings 105 at the hot side radial wall 111 may define a first flow opening 106 defining a first volume in fluid communication between the flow cavity 115 and the hot flow path 101. In another embodiment, the plurality of flow openings 105 at the cold side radial wall 112 may define a second flow opening 107 defining a second volume different from the first volume. The second flow opening 107 defines the second volume in fluid communication between the cold flow path 102 and the flow cavity 115.

In one embodiment, such as depicted in regard to FIG. 4, the plurality of flow openings 105 may further include a third flow opening 108 defined through one or more radial walls 110 between the hot side radial wall 111 and the cold side radial wall 112 adjacent to the cold flow path 102. The third flow opening 108 may define a third volume different from the first volume of the first flow opening 106 and the second volume of the second flow opening 107. The third flow opening 108 is defined in fluid communication between adjacent flow cavities 115 defined between the hot side radial wall 111 and the cold side radial wall 112 adjacent to the cold flow path 102.

Various embodiments of the flow openings 105, such as including the first flow opening 106, the second flow opening 107, or the third flow opening 108, may define the overall pressure loss across the wall assembly 100 such as described above. Additionally, or alternatively, the flow openings 106, 107, 108 may define pressure losses across each radial wall 110 different from another radial wall 110, such as described above.

Referring now to FIGS. 1-6, various embodiments of the wall assembly 100 shown and described herein may be disposed at the combustor assembly 50 of the engine 10. In one embodiment, the outer liner 54 and/or the inner liner 52 includes the outer wall 140 of the wall assembly 100. In another embodiment, the bulkhead 56 includes the mount wall 130 of the wall assembly 100. In still another embodiment, the deflector assembly 57 includes the radial wall 110 and the connecting member 120 of the wall assembly 100.

In various embodiments, the combustor assembly 50 including the liners 52, 54 and the radial wall 110 together define the hot side flow path 101 as the combustion chamber 62. More specifically, in one embodiment, the hot side radial wall 111 and the liners 52, 54 together define the hot side flow path 101 as the combustion chamber 62. In still another embodiment, the combustor assembly 50 including the wall assembly 100 may define the cold side flow path 102 between the bulkhead 56 and the cold side radial wall 112.

Referring still to FIGS. 1-6, the wall assembly 100 may define the first gap 116 substantially circumferentially around the engine centerline 12. In one embodiment, the combustor assembly 50 including the wall assembly 100 defines the first gap 116 substantially circumferentially around the engine centerline 12 between the liner 52, 54 and the radial wall 110. In another embodiment, the wall assembly 100 may further define the first gap 116 substantially circumferentially around the engine centerline 12 between the liner 52, 54 including the outer wall 130 and the hot side radial wall 111. However, it should be appreciated that in embodiments of the engine 10 and combustion section 26 defining a can or can-annular combustor assembly, the first gap 116 may be defined circumferentially around a combustor centerline disposed approximately through the fuel nozzle.

Referring still to FIGS. 1-6, in still various embodiments the combustor assembly 50 including the wall assembly 100 may define the inner wall 140 as a deflector eyelet 58 coupled to the radial wall 110 defining a deflector wall. In one embodiment, the combustor assembly 50 including the wall assembly 100 defines the second gap 117 substantially circumferentially around the engine centerline 12 between the deflector eyelet 58 including the inner wall 140 and the deflector wall including the radial wall 110. In another embodiment, the wall assembly 100 may further define the second gap 117 substantially circumferentially around the engine centerline 12 between the deflector eyelet 58 including the inner wall 140 and deflector wall including the hot side radial wall 111. However, it should be appreciated that in embodiments of the engine 10 and combustion section 26 defining a can or can-annular combustor assembly, the second gap 117 may be defined circumferentially around a combustor centerline disposed approximately through the fuel nozzle.

Embodiments of the wall assembly 100 generally provided herein may reduce leakage and control overall pressure drop, control or modulate cooling, and improve durability. For example, the serial arrangement of the plurality of radial walls 110 may control the overall pressure drop between the cold side flow path 102 and the hot side flow path 101. The improved cooling structure and reduced leakage of across the wall assembly 100 may further improve durability of the surrounding structure, such as the combustor assembly 50 and other portions of the engine 10. Additionally, the wall assembly 100 may improve overall performance or operability of the engine 10, or modules or components thereof.

Although various embodiments of the wall assembly 100 shown and described herein may be included in the combustor assembly 50, various other embodiments may additionally, or alternatively, include the wall assembly 100 in the compressor section 21, the turbine section 31, or the exhaust section 32.

Embodiments of the wall assembly 100 generally shown and described herein may be produced using one or more manufacturing methods known in the art, such as, but not limited to, via one or more processes known as additive manufacturing or 3D printing, machining processes, forgings, castings, etc., or combinations thereof, including unitary components or multiple components joined together via a bonding process (e.g., welding, brazing, adhesive, bonding, etc.), or mechanical fasteners (e.g., bolts, nuts, screws, rivets, tie rods, etc.), or other joining processes. Alternatively, or additionally, various components of the wall assembly 100 may be formed via a material removal process, such as, but not limited to, a machining process (e.g., cutting, milling, grinding, boring, etc.). Furthermore, the wall assembly 100, or portions thereof, may be constructed of one or more materials suitable for heat engines or turbo machines such as, but not limited to, gas or steam turbine engines. Such materials include, but are not limited to, steel and steel alloys, nickel and nickel-based alloys, aluminum and aluminum alloys, titanium and titanium alloys, iron-based materials, composite materials (e.g., CMC, MMC, PMC materials, etc.), or combinations thereof.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A heat engine defining a hot flow path and a cold flow path, the heat engine defining an axial direction and a radial direction, and further defining a combustor centerline extending through a fuel nozzle in the axial direction, the heat engine comprising:

a wall assembly comprising:

a plurality of radial walls coupled together via a connecting member; and an inner wall on an inner side of the radial walls in the radial direction with respect to the combustor centerline, wherein each of the plurality of radial walls defines a flow opening therethrough such that the heat engine comprises a plurality of flow openings, wherein a flow cavity is defined between the plurality of radial walls and the connecting member, wherein a hot side radial wall of the plurality of radial walls closest to the hot flow path has a radial inner terminal end that is a free end not connected to any structure with respect to the combustor centerline, wherein the radial inner terminal end of the hot side radial wall and the inner wall form a gap therebetween, and wherein the gap forms a gap flow path directed partially outwards in the radial direction with respect to the combustor centerline.

2. The heat engine of claim 1, wherein the wall assembly further comprises:

a mount wall extended substantially co-directional to the connecting member, wherein the mount wall is coupled to an outer wall of the heat engine.

3. The heat engine of claim 1, wherein each of the plurality of radial walls defines a thickness, and wherein the flow cavity defines a cross sectional distance, and wherein a ratio of the thickness to the cross sectional distance is between 0.1:1 and 10:1.

4. The heat engine of claim 1, wherein the plurality of radial walls comprises two or more radial walls, and wherein the two or more radial walls comprises the hot side radial wall adjacent to the hot flow path and one or more cold side radial walls adjacent to the cold flow path defining a fluid temperature less than the hot flow path.

5. The heat engine of claim 4, wherein another gap is defined between the hot side radial wall and an outer wall surrounding the hot side radial wall.

6. The heat engine of claim 1, wherein the connecting member of the wall assembly is defined between 70 degrees and between 110 degrees relative to each of the plurality of radial walls.

7. The heat engine of claim 1, wherein one of the flow openings extends through the connecting member.

8. A combustor assembly for a gas turbine engine, the combustor assembly defining an axial direction and a radial direction, and further defining a combustor centerline extending through a fuel nozzle in the axial direction, the combustor assembly comprising:

a liner defining a combustion chamber;

a deflector assembly comprising:

a plurality of radial walls coupled together via a connecting member; and a deflector eyelet disposed on an inner side of the radial walls in the radial direction with respect to the combustor centerline; and a mount wall, wherein each of the plurality of radial walls defines a flow opening therethrough such that the combustor assembly comprises a plurality of flow openings, wherein a flow cavity is defined between the plurality of radial walls and the connecting member, wherein the mount wall is coupled to the liner and one of the plurality of radial walls, and wherein a hot side radial wall of the plurality of radial walls closest to the combustion chamber has a radial inner terminal end that is a free end not connected to any structure with respect to the combustor centerline, wherein the radial inner terminal end of the hot side radial wall and the deflector eyelet form a gap therebetween, and wherein the gap forms a gap flow path directed partially outwards in the radial direction with respect to the combustor centerline.

9. The combustor assembly of claim 8, wherein the plurality of radial walls comprises two or more radial walls, wherein the two or more radial walls comprise the hot side radial wall adjacent to the combustion chamber, and wherein the two or more radial walls comprise one or more cold side radial walls disposed forward of the hot side radial wall.

10. The combustor assembly of claim 8, wherein each of the plurality of radial walls defines a thickness, wherein the flow cavity defines a cross sectional distance, and wherein a ratio of the thickness to the cross sectional distance is between 0.1:1 and 10:1.

11. The combustor assembly of claim 8, wherein a deflector eyelet coupled to one of the plurality of radial walls, wherein a bulkhead assembly is coupled to a liner wall of the liner forward of the deflector assembly, and wherein a cold flow path is defined between the bulkhead assembly, the deflector assembly, and the deflector eyelet.

12. The combustor assembly of claim 11, wherein the combustor assembly defines another gap between one of the plurality of radial walls and the liner.

13. The combustor assembly of claim 12, wherein the another gap is defined substantially circumferentially.

14. The combustor assembly of claim 11, wherein the plurality of flow openings defines a volume providing a pressure loss from the cold flow path to the combustion chamber between 0% and 50%.

15. The combustor assembly of claim 11, wherein the hot side radial wall of the plurality of radial walls defines a first flow opening of the plurality of flow openings defining a first volume in fluid communication between the flow cavity and the combustion chamber, wherein a cold side radial wall of the plurality of radial walls defines a second flow opening of the plurality of flow openings defining a second volume different from the first volume, and wherein the second flow opening defines the second volume in fluid communication between the cold flow path and the flow cavity.

16. The combustor assembly of claim 15, wherein the first volume of the first flow opening corresponds to a pressure loss from the flow cavity to the combustion chamber between 0.1% and 25%.

17. The combustor assembly of claim 15, wherein the second volume of the second flow opening corresponds to a pressure loss from the cold flow path to the flow cavity between 0.1% and 25%.

18. The combustor assembly of claim 15, wherein the combustor assembly defines a second gap between the hot side radial wall and the deflector eyelet.

19. The combustor assembly of claim 8, wherein each of the plurality of radial walls of the deflector assembly is defined substantially along a radial direction from a combustor centerline.

20. The combustor assembly of claim 8, wherein the connecting member of the deflector assembly is defined between 70 degrees and 110 degrees relative to each of the plurality of radial walls.

* * * * *